United States Patent [19]

Langston et al.

[11] Patent Number: 4,643,119

[45] Date of Patent: Feb. 17, 1987

[54] INDUSTRIAL TEXTILE FABRIC

[75] Inventors: Mark C. Langston; David G. Boutwell, both of Summerville, S.C.

[73] Assignee: Exxon Chemical Patents Inc., Linden, N.J.

[21] Appl. No.: 754,504

[22] Filed: Jul. 12, 1985

[51] Int. Cl.[4] ..... B32B 7/08; D03D 3/02; D03D 15/00

[52] U.S. Cl. ..... 112/421; 66/202; 102/282; 102/303; 112/440; 112/262.1; 139/387 R; 139/420 A; 139/420 R; 206/524.6; 220/DIG. 14; 264/177.1; 405/16; 405/53; 405/258; 428/35; 428/229; 428/252; 428/400; 428/910

[58] Field of Search ..... 66/202; 139/420 A, 387 R, 139/420 R; 206/524.6; 220/DIG. 14; 264/177 R, 177 F; 405/16, 53, 258; 102/282, 303; 112/421, 440, 262.1; 428/35, 229, 252, 400, 910

[56] References Cited

U.S. PATENT DOCUMENTS

| | | | |
|---|---|---|---|
| 3,164,948 | 1/1965 | Stratford | 57/31 |
| 3,359,934 | 12/1967 | Schwartz et al. | 139/420 R |
| 3,439,865 | 4/1969 | Port et al. | 428/226 |
| 3,445,055 | 5/1969 | Port et al. | 139/420 R |
| 3,503,106 | 3/1970 | Port et al. | 139/420 R |
| 3,918,135 | 11/1975 | Kim | 139/420 R |
| 3,930,091 | 12/1975 | Lewis et al. | 139/420 R |
| 4,264,659 | 4/1981 | Pattender | 156/78 |
| 4,291,082 | 9/1981 | Stall | 206/524.2 |
| 4,428,698 | 1/1984 | Murphy et al. | 428/229 |
| 4,505,201 | 3/1985 | Abele | 102/282 |

FOREIGN PATENT DOCUMENTS

| | | |
|---|---|---|
| 2134938 | 8/1984 | United Kingdom . |
| 874789 | 10/1981 | U.S.S.R. . |

*Primary Examiner*—James C. Cannon
*Attorney, Agent, or Firm*—R. L. Graham

[57] ABSTRACT

A textile fabric employs a corrugated synthetic flat yarn having a plurality of filaments arranged in side-by-side relationship and being integral with adjacent filaments. The tape is corrugated tape woven or knitted with other yarns in a flat, substantially untwisted attitude. The tape is fabricated without fibrillation but controlled splitting may occur during subsequent fabric sewing or stitching operations. The fabric is particularly suited for use as geotextiles, woven intermediate bulk containers, woven explosive bags, and strapping (webbing).

23 Claims, 3 Drawing Figures

INDUSTRIAL TEXTILE FABRIC

BACKGROUND OF THE INVENTION

This invention relates generally to textiles useful in industrial products. In one aspect, the invention relates to heavy duty textile fabrics, specifically geotextile fabrics, and high impact bags made from woven fabric such as explosive bags and intermediate bulk containers.

There are many industrial uses of textiles which require fabrics of high strength and durability. These fabrics and/or textiles, referred to as industrial textiles, are distinguished from apparel and household textiles on the basis of denier: the industrial textiles employ heavy denier yarns with emphasis on strength and durability whereas the apparel and household textiles employ low denier yarns with emphasis on esthetics.

Many of the industrial textiles are in the form of woven or knitted fabrics made from synthetic tape yarns. Such yarns are extruded flat tapes (or films) woven into the fabric in a flat, untwisted disposition. The flat configuration of the tape yarns provide relatively large area coverage in comparison to round yarns, but still retains the tensile strength in proportion to its cross sectional area. Tape yarns are used as the fill and warp yarns in both woven and knitted fabrics.

Although tape yarns have received considerable use in industrial textiles such as geotextiles, and high impact fabric bags, they present certain operational problems and suffer certain deficiencies, particularly in fabrics that are stitch bonded or needle punched. For example, polypropylene tapes are used as the fill and warp yarns in woven geotextile fabric. These fabrics are joined together by stitching overlapped edge portions of the fabric. More recently, multilayers of fabrics are joined by stitch bonding to produce a geotextile of excellent strength. Also, intermediate bulk containers and explosive bags are frequently fabricated by sewing components together.

It has been discovered that needle penetration in such sewing or stitching operations damage the flat tape yarns to the extent that the tensile strength of the fabric is substantially reduced. Examination of the damaged tape yarns reveals that the needle penetration causes fibrillation (splitting) of the yarn generally in a random direction. Although the tape yarns are oriented in the machine direction (MD), the tape splits caused by needle penetration do not usually propagate in the MD but instead extend in random directions. This not only produces many loose-ended fibrils but also reduces the effective cross-sectional area of the tape and hence its tensile strength. Tests on commercial polypropylene tape yarns have shown that needle penetration reduces yarn tensile strength on an average of 25%, reaching 50% on some samples. Tests on geotextile fabrics stitch bonded together has shown reduction in tensile strength of the final composite by as much as 40% in comparison to tensile strength of the composite without stitch bonding.

Another serious problem associated with flat yarns is their lack of flexibility with respect to the longitudinal axis of the yarn. Tape yarns are rectangular in cross section having a thickness to width ratio (aspect ratio) of between about 1:10 to 1:40. Such flat yarns, because of their thinness, are extremely flexible for winding up and bending around MD curves. However, the relatively narrow width tape is resistant to bending from side-to-side or about its longitudinal axis. Thus, any forces tending to cause the tape to fold along its longitudinal axis will create high stress sites. This stress, coupled with the sharp edges of the tape, results in equipment wear on circular guides or other components which restrict lateral movement of the yarn during textile fabrication. Moreover, in certain weaving operations, such as in circular weaving, the high tensions maintained on the yarns during the weaving operation cause the sharp edges of the circumferential yarns (fill) to damage the longitudinal yarns (warp) to the extent that yarn breakage is a problem.

As described in detail below, the present invention overcomes many of the problems associated with flat tape yarns by using a tape yarn composed of a plurality of rounded filaments arranged in parallel relation and being integral with adjacent filaments. The prior art includes many references which disclose tape yarns of diverse cross sections intended for a variety of uses. For example, U.S. Pat. Nos. 3,164,948, 3,273,771, 3,470,685, 3,495,752 and British Pat. No. 1,202,347 disclose flat tapes comprising individual monofilaments joined by bridges. The purpose of the relatively thin bridges is to aid in promoting fibrillation of the tape. Fibrillation, as the name implies, is a process for forming fibers by splitting the film in the MD. The fibrillated tapes are twisted to form a bundle of fibrils joined at longitudinal intervals. The relatively narrow bridges of the prior art tape permit controlled fibrillation of the tapes prior to or during twisting or working in forming the multifilament yarn. Although the fibrillation improves the appearance and flexibility of the yarns, their use in the twisted bundle sacrifices the principal advantages of flat tape—large surface areas.

SUMMARY OF THE INVENTION

The fabric of the present invention is a woven or knitted fabric which employs interlaced yarns, at least one of which is flat tape composed of a plurality of parallel and rounded filaments arranged in side-by-side relationship and integral with adjacent filaments. The term flat, as used herein, does not refer to the surface profile of the tape but instead to its width-to-thickness relationship. The junctures (i.e., bridge portions) of adjacent filaments have a thickness substantially less than the maximum thickness of the filaments. In woven fabrics, the tape yarns, either as the warp or fill yarns or both, are arranged in a flat, substantially untwisted disposition. In a preferred embodiment, the filaments are circular in cross section and are joined with adjacent filaments by intersecting segmental portions. The grooves on each surface are aligned so the thickness there between defines the minimum thickness dimension of the tape. Likewise, opposite rounded portions define the maximum tape thickness dimension. The tape yarn thus has a corrugated appearance: parallel longitudinal ridges separated by grooves. This structure of alternating ridge and groove sections of reduced thickness impart three features to the tape yarns which are particularly advantageous in industrial textiles: (1) the reduced thickness at the grooves provide lines of weakness in the tape yarn such that when used in sewn or stitch bonded fabrics, the splitting is restricted to the grooves; (2) the grooves impart flexibility to the yarn in the lateral direction, permitting the yarn to radially conform to guides; and (3) the rounded edges do not damage interlaced yarns.

By restricting the tape splitting to the MD, the cross sectional area of the yarn is essentially unchanged even if splitting by needle penetration occurs. It should be noted that since the splitting will arise only on needle penetration and generally will extend only a short distance, the vast majority of the tape yarns will be unsplit.

The lateral flexibility coupled with the rounded configuration of the filaments reduces wear on equipment components and reduces the tendency of fill yarns in circular weaving from damaging warp yarns. Moreover, the flexibility imparts "softness" to the fabric and improves handling (woven fabric of conventional flat tapes are stiff and are difficult to handle).

An important feature of the present invention is found in fabrics for geotextiles, intermediate bulk containers (IBC), explosive bags, and strapping (webbing) such as that sewn to IBC's, all of which are specifically disclosed and claimed herein. However, other uses of the industrial fabric constructed according to the present invention will become apparent to those skilled in the art.

DESCRIPTION OF THE PREFERRED EMBODIMENTS

The industrial fabric of the present invention may be in the form of a woven fabric or a knitted fabric. In both woven and knitted fabrics, the warp and fill yarns may include the tape yarns described herein. Preferably, however, the tape yarn described herein will be used in the fabric in a substantially untwisted disposition.

The corrugated yarn may be made of any of the polymers capable of being processed to form the yarn possessing the properties for the end use product. These polymers typically include polyolefins (e.g., polypropylene and polyethylene), polyamides, polyesters, polyvinyl derivatives (e.g., polyacrylonitrile, PVC), polyurethanes, etc. A more detailed list of polymers useful in textiles is found in *Textile Yarns, Technology, Structure, & Applications,* published by John Wiley & Sons, Inc. copyrighted 1977.

As indicated above, a novel feature of the fabrics constructed according to the present invention is in the configuration and disposition of the tape yarn. The tape yarn is manufactured by direct extruding a polymer through a specially configurated die, followed by cooling and subsequent orientation.

Figure 1:
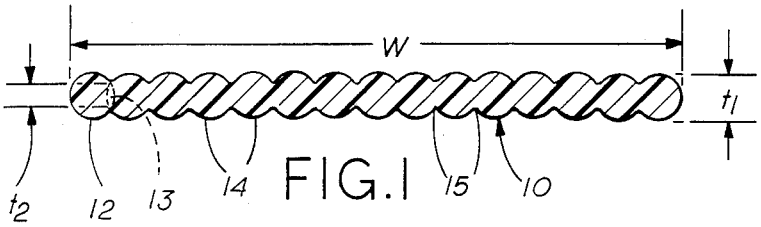
FIG. 1 is a transverse sectional view of a tape yarn useful in the fabric of the present invention.

The tape yarn will have a cross section generally of the same shape as the die but of much smaller dimensions because of the draw-down during extrusion and the subsequent orientation. As shown in FIG. 1, the yarn 10 is generally flat and consists of a plurality of longitudinal filaments 12 which are arranged in side-by-side relationship and which are integrally joined with adjacent filaments at juncture 13. The yarn 10 thus is provided on each surface with a plurality of rounded ridges 14 separated by grooves 15. The tape yarn 10 is symmetrical with respect to the longitudinal cutting plane through tape center. The maximum yarn thickness ($t_1$) defined by the peaks of opposite ridges 14, is substantially greater than the minimum yarn thickness ($t_2$) defined by opposite grooves 15. The number of integrally formed filaments 12 will depend on their diameters and the desired width (w) of the tape. The $t_2/t_1$ ratio should be large enough to retain integrity of the tape 10 during fabrication and use, but small enough to control splitting resulting from needle penetration.

The configuration of the individual filaments are preferably circular but can be in any rounded form such as oval, elliptical, etc. For example, in low denier tapes, it may be preferred to employ oval shaped filaments wherein the minor axis defines the maximum thickness of the tape and major axis lies in the plane of the fabric. It is important, however, that the filaments be rounded, particularly at the edges, to avoid any sharp edges that can wear equipment or damage adjacent or cross-laid yarns. Moreover, the filaments may be of different diameters.

As indicated above, the $t_1/t_2$ ratio can vary with a wide range. The criteria for this key relationship is that the juncture between adjacent filaments should be sufficiently strong to maintain the yarn integrity during weaving and use and sufficiently thin to provide controlled splitting by needle penetration. This criteria will inherently result in a flexible yarn.

Because of its distinctive surface profile the tape yarn 10 is referred to herein as corrugated yarn.

Except for the configuration of the die, the yarns 10 can be made by conventional tape-forming processes using conventional polymers. Such processes normally involve orientation which may be carried out at elevated temperatures using conventional godetes. Annealing may also be included in the operation. However, fibrillation should be avoided. Moreover, twisting should be avoided in all but the warp yarns of knitted fabrics. The yarn is wound up on conventional rollers or spools for use on textile equipment.

For industrial textile fabrics, the tape yarns may have the following dimensions:

| | Range | Preferred Range |
|---|---|---|
| Total yarn width (w), microns | 100 to 6000 | 1000 to 4000 |
| Number of filaments | 3 to 50 | 10 to 20 |
| Yarn denier | 200 to 5000 | 500 to 2500 |
| Maximum thickness ($t_1$), microns | 10 to 500 | 70 to 200 |
| $t_2/t_1$ ratio | 0.20 to 0.95 | 0.3 to 0.8 |

The invention also contemplates the use of yarns having corrugated sections separated by flat sections. The flat sections may have a thickness ranging from $t_1$ to $t_2$. Thicknesses of the flat sections approaching $t_2$ will impart flexibility to the yarn permitting flanking corrugated sections to fold over if desired. Thicknesses approaching $t_1$ will impart stiffness to the yarn. The flanking corrugated sections will confine fibrillation to the flat section.

Figure 2:
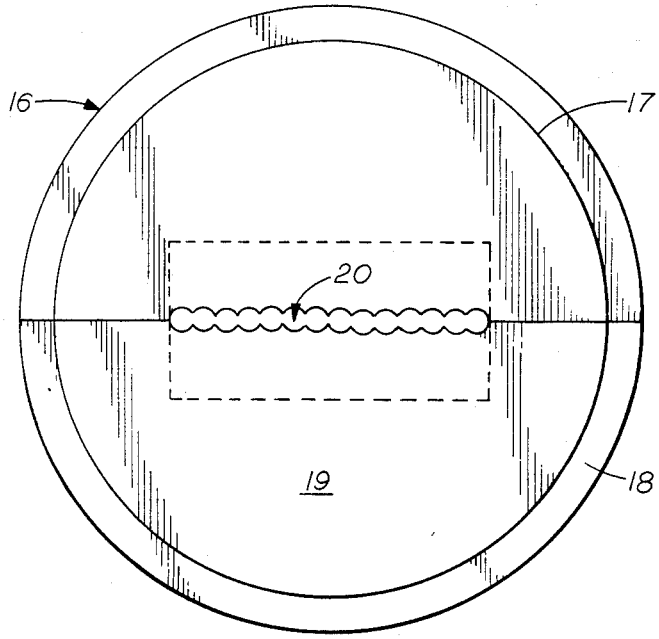
FIG. 2 is an end view of a die useful in extruding the tape yarns for use in the present invention.
Figure 3:
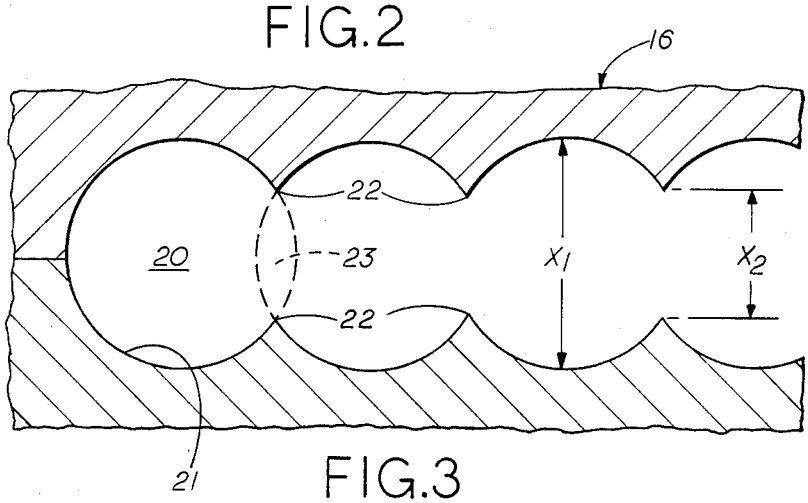
FIG. 3 is an enlarged fragmented transverse sectional view of the die shown in FIG. 2, illustrating details of the die hole construction.

FIGS. 2 and 3 disclose a die 16 useable in the manufacture of the corrugated yarn. The die 16 composed of high-quality steel, comprises a cylindrical body 17 having a flange 18 at one end thereof and a face 19 at the opposite end. An elongate slot 20 is formed in the die face 19 and is the shape of a plurality of side-by-side holes 21 having intersecting peripheral portions. The rounded portions are thus separated by pointed teeth 22, giving the opposing die surfaces a serrated appearance.

With reference to FIG. 2, the serrated die may be formed by drilling a plurality of circular holes 21 in the die face, the axis of each hole preferably being less than 1 diameter from that of its adjacent hole such that the hole diameters intersect as illustrated at 23. The intersections provide an opening for the integral formation or junction of adjacent filaments as the molten polymer is extruded therethrough. The maximum thickness $X_1$ of the die opening is equal to the diameter of each hole and the minimum thickness $X_2$ of the minimum die gap is the distance between opposite teeth 22. The teeth points 22 may be ground down to provide flat lands if desired. This provides means for adjusting the dimension $X_2$.

The integrally joined filaments may also be formed using rounded holes separated by small lands at 22. However, the structure of FIG. 3 is preferred.

The dimensions of the die will depend upon several factors including the final dimensions of the corrugated yarn and process conditions (e.g., drawdown and orientation). The following are die dimensions suitable for manufacturing the corrugated yarns described above:

| | Range | Preferred Range |
|---|---|---|
| Die width, microns | 2000 to 20000 | 5000 to 12000 |
| Hole diameter or thickness ($X_1$), microns | 50 to 2000 | 300 to 800 |
| Number holes | 3 to 50 | 10 to 20 |
| $X_2/X_1$ | 0.2 to 0.95 | 0.3 to 0.8 |

Flange 18 at the base of the die provides a means for mounting the die to an extrusion head. In practice, a plurality of these dies may be used to extrude several individual corruguated tapes.

FABRICS FORMED WITH FLAT CORRUGATED YARNS

The fabrics of the present invention include those which use flat tapes in substantially untwisted and unfibrillated form. These include woven fabrics and knitted fabrics. Some twisting may occur in the warp yarns of knitted fabrics, but the yarns, nevertheless, are substantially untwisted.

In its broadest aspect, the invention comprises a fabric for industrial textiles having a plurality of warp yarns interlaced with a plurality of fill yarns, wherein either or both the fill and warp yarns comprise corrugated yarns described herein. The denier and spacing of warp and fill yarns will depend upon end use of the fabric. For industrial textiles, the denier ranges from 500 to 5000 and the spacing from between 5 and 60 ends per inch. The woven fabric may be manufactured using conventional textile weaving equipment which is capable of weaving tape yarns in the flat disposition and knitted fabric may be manufactured by conventional knitting equipment capable of inserting the fill yarn in the flat disposition. The fabric constructed according to the present invention is particularly useful in geotextiles, woven intermediate bulk containers, woven explosive bag fabrics, and woven strapping or webbing. Details of the invention in each of these embodiments is described below.

Geotextile Fabric

Geotextiles are usually woven fabrics (although knitted fabrics are also used) used with foundation, soil, rock, earth or any geotechnical engineering related material, that is an integral part of a man-made project, structure, or system. Such materials are typically used in the construction of roadways, embankments, drains, erosion control systems, and a variety of other earthwork structures. Geotextiles are described in "Geotextile Products", by J. P. Geroud et al. published in *Geotextile Fabrics Report,* Summer 1983.

The geotextile construction according to the present invention are woven or knitted fabrics having warp and fill yarns system-7atically interlaced to form a plainar structure. As mentioned earlier, both the warp and fill yarns may be the form of corrugated yarn 10 illustrated in FIG. 1. In woven geotextiles the three basic weave patterns may be used, with the plain weave being preferred. Typical ranges of yarn denier and spacing are presented below.

| | Denier | Ends/Inch |
|---|---|---|
| Warp yarns | 500–3000 | 6–25 |
| Fill yarns | 500–3000 | 6–25 |

Composite geotextiles prepared by joining fabric are particularly effective in developing high strengths required for many geotextile applications. It has been found that by stitching together multiple layers of the geotextile, extremely strong composites are obtained. In order to avoid the destructive effects of the needles used in the stitching process, the corrugated tape yarns described above are particularly useful in the present invention. The following examples illustrate the effectiveness of these tape yarns in the context of geotextile fabrics.

In forming the composites, two or more superimposed fabrics, one or more of which are woven with corrugated yarns, are fed into a stitch bonding machine such as a Malimo made by Textima of East Germany, which joins the fabrics by a stitching yarn. The stitching may take a variety of forms including knit arrangements such as chain loops, tricot loops, etc. However, The plain stitch is preferred because of its simplicity. The spacing between adjacent stitch rows typically ranges from 0.2 to about 1 inch. The yarn size and distance between stitches may be that used in stitch bonding geotextiles. Reference is made to U.S. Pat. No. 4,472,086, the disclosure of which is incorporated herein.

Geotextile fabrics, either as fabric or composite fabric, frequently are joined in the field by stitching together overlapped edge or end portions of the fabric. The fabric of the present invention can be joined without loss of strength because the needle penetration does not damage the yarns.

In use, the geotextile is placed in contact with an earth structure to maintain the integrity of the structure.

Intermediate Bulk Container (IBC)

Despite the growing popularity of intermediate bulk containers (IBC), these industrial size transport containers have not received a universally recognized definition. As used herein, IBC is a large, heavy-duty bag designed to handle loads up to two metric tons. IBC's are described in "Intermediate Bulk Containers: The Bite-Size Approach to Bulk Handling", published in *Material Handling Engineering,* October 1984, the disclosure of which is incorporated herein by reference. The denier and weave density may be as follows:

| | Broad Range | Preferred Range |
|---|---|---|
| Warp denier | 500 to 5000 | 1000 to 3000 |
| Fill denier | 500 to 5000 | 1000 to 3000 |
| Warp density, ends/inch | 7 to 30 | 8 to 15 |
| Fill density, ends/inch | 7 to 30 | 8 to 15 |

It is preferred that the flat corrugated tape yarn described above and illustrated in FIG. 1 be used as both the warp and fill yarns. It is also preferred that the IBC using the corrugated yarns be manufactured by the circular weaving method wherein a tubular fabric is made by conventional circular weaving. Using this process, a continuous fill corrugated yarn is fed through a plurality of fixed warp yarns arranged in a circle. The fill yarn is continuously woven with the warp yarns. As the weaving proceeds, the woven tube is withdrawn and wound on a roll. Because of the relatively high tension maintained on the yarns during the weaving process, the conventional flat yarns have a tendency to damage the warp yarns. However, the corrugated yarns described above are pliable and readily conformable. Moreover, the edges are rounded which reduces the tendency of the circumferential yarn to damage the warp yarns.

The circular woven fabric is cut into longitudinal sections and tops and bottoms are stitched to the tubular section. The corrugated tape yarns used in the tubular portion and the bottom portion permit the sewing without loss of fabric strength. Moreover, straps or webbing are frequently sewn onto the IBC. The corrugated yarn also permits this sewing action without loss of strength in either IBC or the straps or webbing. The straps are high strength, tightly woven fabrics (weave density of 30 to 60 ends per inch, with 40 to 50 being preferred and yarn denier of 1000 to 3000). The straps or webbing provide reinforcement for the bag and also serve as sling loops for bag transport.

Explosive Bag Fabric

As described in U.S. Pat. No. 4,505,201, impact resistance of explosive bags can be improved by manufacturing the bags out of woven fabric, particularly continuously by the circular weaving process. The explosive bag fabric is made in tubular form by a conventional circular weaving machine such as manufactured by Lenzing Corp. of Austria. In this process, longitudinal or warp yarns at the desired spacing are placed in the continuous weaving apparatus in parallel fixed relationship. The fill yarns or circumferential yarns are woven through the longitudinal yarn in a continuous manner forming a tubular woven fabric. In accordance with this invention, the yarn used as the fill yarns, and preferably as both yarns, is the corrugated flat yarn disclosed in FIG. 1 and described herein. As the weaving progresses, a tube of the woven fabric is withdrawn and wound on a takeup spool. In manufacturing the explosive bag, the ends of the tubular fabric are lapped over and stitched to provide a bottom closure. As in the case of the IBC fabric, the high tension maintained in the yarns during the weaving operation using conventional flat tape tends to damage the yarns. However, because of the increased flexibility resulting from the corrugated yarns, this damage has been reduced substantially. Moreover, the yarn damage resulting from stitching is avoided by use of the corrugated flat yarn. It should be observed that the invention has also particular application in the manufacture of explosive bag fabric prepared by weaving a flat fabric and overlapping and sewing longitudinal portions to form the tube.

EXPERIMENTS

The following experiments were carried out to demonstrate the effectiveness of the present invention, particularly in yarn for IBC. However, the principles demonstrated therein are equally applicable to other industrial fabrics, particularly geotextiles and explosive bag fabrics.

EXPERIMENTAL MATERIAL

Experimental material tests were conducted on various formulated tape yarns and at various conditions. Samples of two nominal sizes were prepared. The formulations used are shown in Table I.

TABLE I

| Formula | Composition | Wt. % |
|---|---|---|
| A | Polypropylene[1] | 100 |
| B | Polypropylene[1] | 85 |
| | Linear Low Density Polyethylene[2] | 10 |
| | Additive Masterbatch[3] | 5 |
| C | Polypropylene[1] | 95 |
| | Additive Masterbatch[3] | 5 |
| D | Polypropylene[1] | 95 |
| | Additive Masterbatch[4] | 5 |

[1]Marketed by Exxon Chemical Company as 4092
[2]Marketed by Exxon Chemical Company as LL 1002.59
[3]Marketed by Ferro Company as AL 46059
[4]Marketed by Ampacet Company as 49674

Sample Preparation: The tape yarn was prepared by direct extruding the polymer through dies, quenching the extruded web, stretch orienting and annealing the web at an elevated temperature, and cutting 30 cm long strip samples of each tape yarn.

The processing conditions were as follows:

| | |
|---|---|
| extrusion temperature | 260° C. |
| quench gap | $1\frac{1}{2}$–$3\frac{1}{4}$ inches |
| quench temperature | 30° C. |
| orienting temperature | 160° C.–190° C. |
| annealing temperature | 150° C. |

The draw ratio was 7.5:1 for all samples except for sample 4 which was 8:1.

The serrated die used in the experiments had the general configuration of FIG. 2 and having the following dimensions:

width = 1.085 mils
number of holes = 14
$X_1$ = 0.79 cm
$X_2$ = 0.25 cm

The plain die used to prepare the standard sample was a flat 1.07 cm by 0.53 cm die.

Test: 30 cm long tape samples were tested in an Instron tester (ASTM No. D-2256) for determining tensile properties of the tape yarn. Test tape identified as regular (Reg) were performed without any needle punching.

The tests identified as "puncture tests" were performed after the sample was randomly punctured with a needle to simulate machine sewing. Ten punctures per 8 inches were made using the standard Malimo stitch bonding needle.

At least 5 strips were used in each test. The data presented in Table II are the arithmetic average for the samples tested.

The following describes the measurements:

Peak load: The maximum force measured at failure

Peak stress: The peak load divided by denier (gram force/denier)

Peak strain: The percent elongation at failure

Modulus: The stress at 5% elongation

The tests on the standard flat tape demonstrate the damage to the tape by needle penetration. The peak load without needle penetration was 18.68 pounds whereas the peak load with needle puncturing was 13.83 pounds. Thus, the plain film after needle puncturing retained only about 74% of its peak load. The puncture tests on Samples 2, 3, 4, and 5, however, reveal that the punctured corrugated tape retained from 90 to 100% of its original load carrying capacity. Equally important is the percent elongation retention. Using the standard tape only 58 percent of the elongation was maintained

TABLE II

| Sample No. | Formula | Test Type | Peak Load (lb) | Peak Stress (GF/D) | Percent Load Retention | Peak Strain (%) | Percent Elongation Retention | Denier | Modulus (GF/d @ 5%) |
|---|---|---|---|---|---|---|---|---|---|
| 1 | A | Reg | 23.44 | 5.906 | | 26.08 | | 1.800 | 1.715 |
| 2 | C | Reg | 24.38 | 5.867 | | 29.73 | | 1.884 | 1.699 |
| 2 | C | Puncture | 21.93 | 5.287 | 90.0 | 22.77 | 76.6 | 1.884 | 1.699 |
| 3 | B | Reg | 21.70 | 5.586 | | 20.97 | | 1.761 | 1.883 |
| 3 | B | Puncture | 22.24 | 5.724 | 100 | 21.46 | 100 | 1.761 | 1.939 |
| 3 | B | Reg | 23.74 | 5.704 | | 22.96 | | 1.887 | 1.921 |
| 3 | B | Puncture | 22.40 | 5.382 | 94.4 | 20.38 | 88.8 | 1.887 | 1.903 |
| 4 | B | Reg | 23.14 | 5.711 | | 22.71 | | 1.838 | 1.819 |
| 4 | B | Puncture | 22.77 | 5.620 | 98.4 | 22.83 | 100 | 1.838 | 1.774 |
| 5 | D | Regular | 19.69 | 6.210 | | 24.57 | | 1.438 | 1.907 |
| 5 | D | Puncture | 19.14 | 6.092 | 97.2 | 22.32 | 90.8 | 1.425 | 2.037 |
| Standard | D | Reg | 18.68 | 5.745 | | 18.16 | | 1.474 | 2.347 |
| | D | Puncture | 13.83 | 4.253 | 74.0 | 10.54 | 58 | 1.474 | 2.377 |

What is claimed is:

1. A textile fabric comprising (a) synthetic warp yarns disposed in side-by-side relationship and parallel to one another; and (b) synthetic fill yarns disposed in side-by-side relationship and parallel to one another and being interlaced with said warp yarns, said warp yarns or said fill yarns or both being extruded flat tapes have a corrugated configuration wherein the tapes (i) have a width-to-thickness ratio of at least 10:1 and (ii) comprise from 10 to 40 rounded filaments arranged in side-by-side relationship and integral with adjacent filaments by intersecting segmental portions, the juncture of adjacent filaments having a thickness of from 0.3 to 0.8 of the thickness of the filaments, and (iii) have a denier of at least 500.

2. A textile fabric as defined in claim 1 wherein the fill yarns have the corrugated configuration and are disposed in a flat, substantially untwisted attitude.

3. A textile fabric as defined in claim 1 wherein the warp and fill yarns are interlaced in a woven pattern.

4. A textile fabric as defined in claim 1 wherein the tapes comprise a plurality of generally circular intersecting filaments.

5. A textile fabric as defined in claim 1 wherein the filaments are oval shaped, the minor dimension of the oval defining the maximum thickness of the tape and the major dimension lying substantially in the plane of the fabric.

6. A textile fabric as defined in claim 1 wherein the yarns are composed of polyolefin.

7. A geotextile fabric comprising (a) a plurality of parallel warp yarns composed of synthetic polymer and having a denier of at least 500;

(b) a plurality of parallel fill yarns composed of synthetic polymer and interwoven with said warp yarns, and having a denier of at least 500, said fill yarns being in the form of direct extruded flat, substantially untwisted tape having a width-to-thickness ratio of at least 10:1 and comprising from 10 to 20 rounded filaments arranged in side-by-side relationship, said filaments being integrally joined with adjacent filaments by intersecting segmental portions, the juncture of which has a thickness of from 0.3 to 0.8 maximum thickness of the filaments.

8. A geotextile fabric as defined in claim 7 wherein the warp and fill yarns each have a denier between 500 and 3,000 and a yarn spacing of 6 to 25 ends per inch.

9. A composite geotextile comprising (a) a first layer of a fabric; and (b) a second layer of the fabric defined in claim 8 stitch bonded to said first layer by a plurality of parallel rows of stitches extending in the machine direction.

10. A composite geotextile as defined in claim 9 wherein said first layer is of the fabric defined in claim 7.

11. A geotextile fabric comprising (a) a first section of the geotextile fabric defined in claim 7; and (b) a second section of the geotextile fabric defined in claim 7, said first and second sections having overlapped edge portions and being bonded together by a stitching yarn.

12. In combination (a) an earth structure; and (b) a geotextile fabric as defined in claim 7 in contact with a portion at least of said earth structure to provide structural integrity for the earth structure.

13. In combination (a) an earth structure; and (b) a geotextile fabric as defined in claim 9 in contact with a portion at least of said earth structure to provide structural integrity for the earth structure.

14. An intermediate bulk container comprising (a) side walls made of the textile fabric defined in claim 1;

(b) a bottom section stitched to a lower edge portion of the side walls; and (c) a top closure stitched to the upper edge portion of the side walls.

15. An intermediate bulk container comprising (a) a continuous tubular body section made of the fabric defined in claim 2;

(b) a bottom section stitched to a lower end portion of the tubular body section, and (c) a top closure stitched to an upper end portion of the tubular body section.

16. An elongate explosive bag comprising a continuous tubular section made of the fabric defined in claim 1 wherein the warp yarns are disposed generally parallel to the longitudinal axis of the bag.

17. An elongate explosive bag as defined in claim 16 wherein a lower end portion of the tubular section is folded over and stitched to provide a bottom closure for the bag.

18. A woven strapping comprising in the form of flat tape yarns (a) a plurality of extruded, flat tape warp yarns, each comprising a plurality of integral adjacent, rounded filaments arranged in side-by-side relation and being joined by intersecting edge segmental portions the juncture of adjacent filaments having a thickness substantially less than the thickness of the filaments, said fill yarns having a denier of between 1000 and 3000 and a yarn spacing of at least 40 ends per inch and being woven in a substantially untwisted disposition.

(b) a plurality of fill yarns interlace with said warp yarns.

19. In combination (a) an intermediate bulk container as defined in claim 14; and (b) strapping as defined in claim 18 sewn to the side walls of the intermediate bulk container and arranged to provide sling loops for lifting said intermediate bulk container.

20. A process for manufacturing an industrial textile which comprises (a) forming a first fabric by interlacing synthetic warp and fill yarns to form a fabric, either or both of said yarns being direct extruded, flat, substantially untwisted tapes and comprising at least 10 adjacent rounded filaments arranged in side-by-side relationship and being integrally joined at segmentally intersecting edge juncture sections, the ratio of the thickness of the juncture sections to the maximum thickness of the filaments ranging from 0.3 to 0.8;

(b) superimposing a portion at least of a second fabric over said first fabric; and (c) stitching the fabrics together with a stitching yarn.

21. A process for manufacturing an industrial textile which comprises (a) direct extruding a molten synthetic resin through a die having a die opening defined by a plurality of rounded opposed wall sections arranged in side-by-side relation, the maximum thickness of the die opening being between 300 and 800 microns, and the ratio of the minimum to maximum thickness being between 0.3 and 0.8, (b) stretch orienting the flat tape yarn thereby forming a corrugated flat tape yarn comprising at least 10 rounded filaments integrally joined in side-by-side relationship by intersecting segmental edge portions, and (c) interlacing a plurality of the corrugated tape yarns with a plurality of yarns arranged substantially perpendicular to the corrugated yarns to form a fabric, said corrugated yarns being arranged in a flat, nonfibralated, substantially untwisted disposition.

22. A process as defined in claim 21 further comprising stitching said fabric comprising corrugated yarns with a second fabric whereby yarn splitting caused by needle penetration is restricted to the ridge proximate the needle penetration.

23. A process for forming a circular tube of woven material which comprises continuously weaving, under tension, a corrugated yarn through a plurality of fixed warp yarns arranged in a circle, the improvement wherein the corrugated yarn comprises from 10 to 20 filaments arranged in side-by-side relationship and integrally joined by intersecting edge segmental portions, the junctures being from 0.3 to 0.8 as thick as the diameters of the filaments, said tape having a width to thickness ratio of at least 10:1.

* * * * *